United States Patent [19]

Buck

[11] 4,028,783

[45] June 14, 1977

[54] IDLER ROLL FOR PRINTING PRESS DRYING STAGE

[75] Inventor: Homer G. Buck, Newport, Oreg.

[73] Assignee: King Label Company, El Segundo, Calif.

[22] Filed: May 14, 1976

[21] Appl. No.: 686,370

Related U.S. Application Data

[63] Continuation of Ser. No. 562,260, March 26, 1975, abandoned.

[52] U.S. Cl. ..... 29/117; 29/123; 101/422

[51] Int. Cl.[2] ..... B41F 13/02

[58] Field of Search ..... 101/219, 228, 418, 425, 101/422; 29/117, 123, 125, 129, 126, 129.5, 120, 148.4 R, 148.4 D; 292/256.6, 256.65, 256.67; 85/67, 70; 403/370

[56] References Cited

UNITED STATES PATENTS

| | | | |
|---|---|---|---|
| 1,537,439 | 5/1925 | Griffith | 29/120 |
| 1,958,299 | 5/1934 | Ericksson | 29/117 |
| 2,542,967 | 2/1951 | Whechter | 85/67 X |
| 2,647,300 | 8/1953 | Thomas et al. | 29/120 |
| 2,684,497 | 7/1954 | Graham | 29/120 X |
| 2,703,918 | 3/1955 | Muza | 29/120 X |
| 3,097,022 | 7/1963 | Sernetz | 29/117 |
| 3,308,522 | 3/1967 | Miller | 29/120 |
| 3,635,158 | 1/1972 | Budinger | 101/425 X |
| 3,649,985 | 3/1972 | Hunt | 29/117 X |
| 3,677,177 | 7/1972 | Smith, Jr. | 101/228 |
| 3,805,550 | 4/1974 | Patton | 29/129 X |

FOREIGN PATENTS OR APPLICATIONS

| | | | |
|---|---|---|---|
| 215,887 | 11/1960 | Austria | 29/117 |

*Primary Examiner*—Edgar S. Burr
*Assistant Examiner*—Paul J. Hirsch
*Attorney, Agent, or Firm*—Frederick E. Mueller

[57] ABSTRACT

A stiff tubular sleeve is externally coated with grit and is telescopically matingly rigidly supported by an idler roll of a continuous printing press. The sleeve and idler roll are detachably keyed together, by an internal clamping mechanism, against both relative axial and angular movements, for rotation in unison as an ink-bearing side of a previously imprinted web of paper or the like runs over the grit coating of the sleeve. Release of the clamping mechanism allows replacement of a sleeve whose grit coating has accumulated excessive ink.

4 Claims, 4 Drawing Figures

IDLER ROLL FOR PRINTING PRESS DRYING STAGE

This is a continuation of application Ser. No. 562,260 filed Mar. 26, 1975, now abandoned.

The present invention relates to rotary printing presses and, more particularly, to an improvement in the idler rolls of a printing press in the drying section thereof.

In a typical printing press, e.g., label printers, the web of the coil of raw stock is sequentially run through a printing stage, a drying stage, and thence onto a take up roll. In view of the necessity of allowing sufficient time for the ink to dry before the imprinted web is wound onto the take up roll, the web is trained through a sinuous path over several sets of idler rolls in the drying stage, sufficient to provide the requisite drying time interval. Those idler rolls of the drying stage over which the imprinted side of the web is trained are helically wound with a grit coated tape that is adhesively secured to the roll. While the sharp hard granules inhibit transfer of ink from the web onto the grit, ink nevertheless accumulates thereon to such an extent that the printed pattern is damaged unless the idler roll is timely reworked to provide it with a new, clean grit tape coating.

Rework of an idler roll entails its removal from the machine to strip the used length of grit coated tape therefrom after which the roll surface must be thoroughly cleaned with a solvent preparatory to applying a new coat of adhesive onto which a new tailored length of the grit coated tape is helically wound. There are a great many idler rolls in the drying stage of a typical press for carrying the imprinted side of the web. With the current practice each of these must be maintained at a labor expenditure of 20 to 30 minutes. Depending on the rate of usage of the press such maintenance may have to be performed as often as several times each day. As a consequence, the labor cost of maintenance is substantial and, since the press is inoperable in the absence of the idler roll or rolls being reworked, the down-time of the machine may represent a very significant loss.

Figure 1:
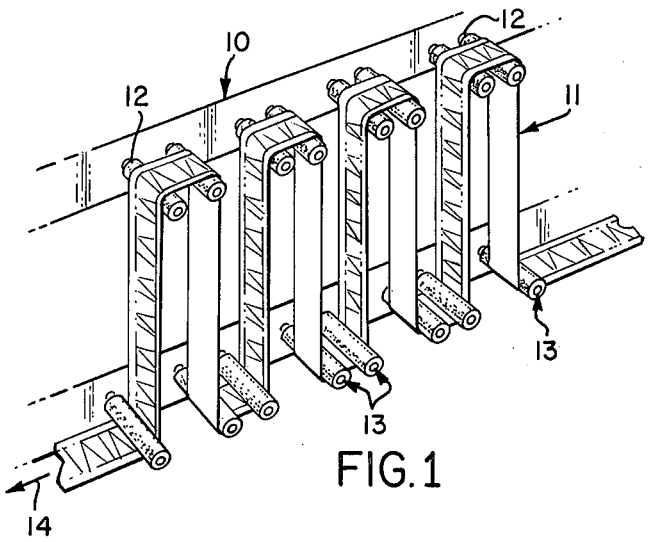
FIG. 1 is a schematic partial perspective view of a drying stage of a printing press employing idler rolls of the present invention.

By way of illustration, the invention is shown in FIG. 1 as embodied in the drying stage of an otherwise conventional label printing press generally indicated at 10. A web 11 of paper or the like is trained around a series of upper idler rolls 12 and lowermost idler rolls 13. The arrangement in this instance is such that the latter are engaged by the imprinted side of web 11 while the uppermost idler rolls 12 are engaged by the unprinted side of the web. It will be understood that the web 11 is under tension and is drawn through the drying stage in the direction indicated by the arrow 14, to a take up roll (not shown). It also will be understood that the web 11 enters the drying stage of the press directly after having had the desired information imprinted on one side thereof with the ink still wet. Because of the lack of ink on the unprinted side of the web, the idler rolls of the drying stage bearing thereagainst, in this case the uppermost idlers 12, merely take the form of smooth surfaced metallic cylinders which are driven on their supporting shafts by the passage of the web 11 thereover. However, in order to avoid transfer of ink from the printed side of the web to the idler rolls engaged thereby, the prior art has employed idlers of the type shown in FIG. 2.

More specifically, the prior art idler comprises a metal cylinder 15 internally fitted at one end portion with a spaced pair of coaxial ball bearing assemblies 16 adapted to be mounted on a corresponding support shaft in the drying section of the press. The exterior of the cylinder 15 is completely coated with an adhesive 17 after which the smooth side of a grit coated length of tape 18 is helically wound therearound. After the adhesive 17 has set, portions of the length of tape 18 projecting axially beyond the opposite ends of the cylinder 15 are trimmed to define terminal edges thereof in the same plane as the diametral planes of the opposite ends of the supporting cylinder. The reworked idler can then be placed in the press as an idler in contact with the inked side of the web, the grit serving to inhibit transfer of the ink thereto from the printed side. After the grit of the tape 18 has accumulated a load of ink, the cylinder 15 must be removed from the press and the tape 18 and adhesive 17 stripped therefrom prior to repetition of the above described time consuming process.

Figure 3:
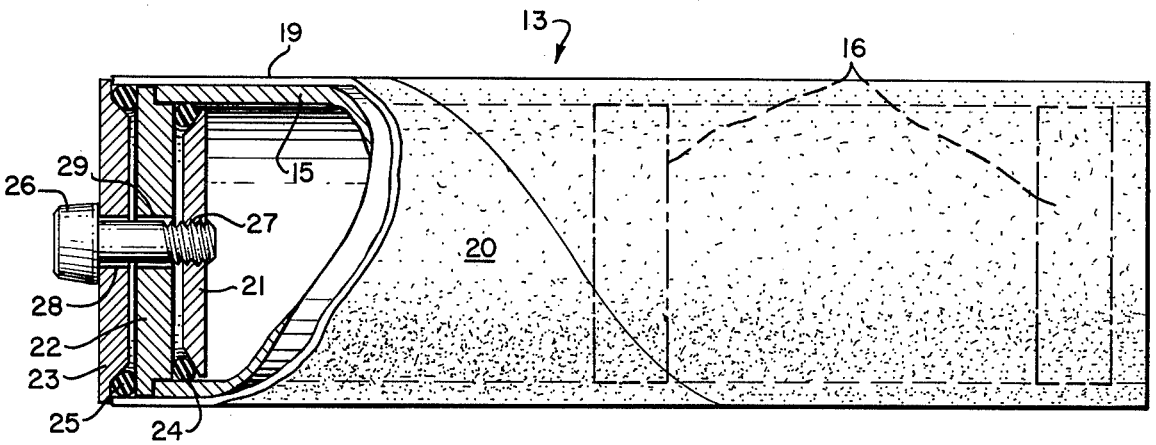
FIG. 3 is an elevational view, partially in section, of the idler roll construction of the present invention.
Figure 4:
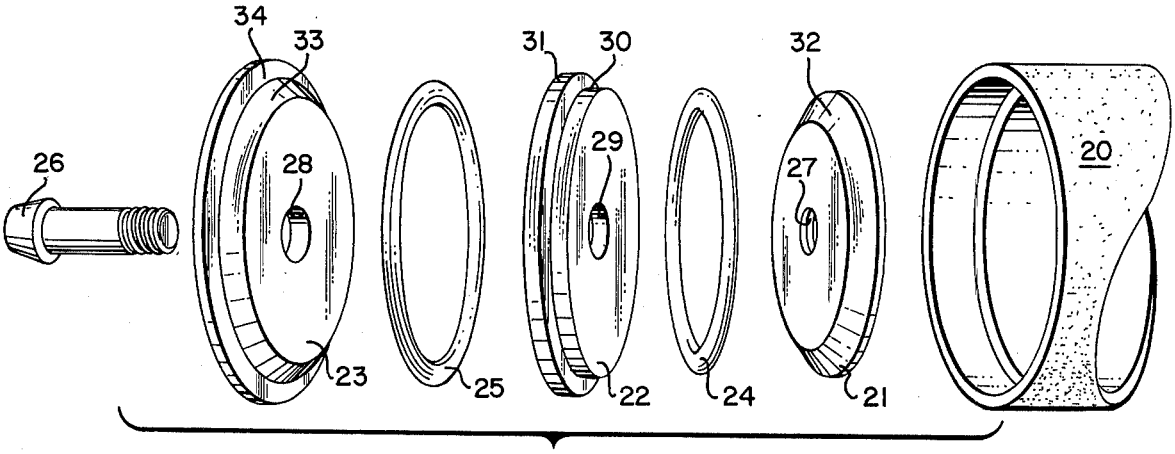
FIG. 4 is an exploded perspective view illustrating the configurations of components of the idler roll construction of this invention.

Referring to FIG. 3, the idler roll 13 of the present invention includes a rigid cylindrical support member which may, for example, be the metal cylinder 15 of the prior art and internally equipped, as before, with the spaced pair of bearings 16. However, in lieu of the adhesive 17 and tape 18 of the prior art, the present invention employs a stiff sleeve 19, e.g., a paper core, having a smooth internal surface adapted for a close sliding fit over the clean outer surface of the cylindrical member 15, the sleeve 19 being externally helically wound with grit tape 20 as is indicated in FIGS. 3, 4.

In order to key the grit coated sleeve 19 against both axial and angular displacement relative to the supporting cylinder 15, the two are keyed together by a clamping arrangement of a type which is quickly engageable and disengagable with the two members to allow speedy removal of a spent sleeve 19 and replacement of a new sleeve, all without removal of the cylinder 15 from its supporting shaft on the press 10. Preferably, this takes the form of a radially expandable and retractable clamping assembly of the type shown in FIGS. 3 and 4.

The clamp comprises an inner disc 21, median disc 22, and an outer disc 23. An elastomeric O-ring 24 is disposed between confronting surfaces of the discs 21 and 22 and another elastomeric O-ring 25 is interposed between confronting surfaces of the discs 22 and 23. The clamping mechanism is operated and held in assembled relationship by a headed tap bolt 26, threadedly engaged at its inner end with a tapped central aperture 27 of the inner disc 21, the latter part acting as the nut in the combination. The outer disc 23 and intermediate disc 22 are formed with plain through bores 28 and 29 receiving a preferably unthreaded shank portion of the bolt therethrough with clearance.

In order to seat the clamp assembly in place, the median disc 22 is peripherally formed with annular shoulder 30 whose cylindrical axially projecting surface is adapted for telescopic engagement with the interior surface of the cylindrical member 15, the radially projecting surface of the shoulder 30 being seated against the outer end of the member 15 and defining a radially outwardly extending flange 31 of a diameter to be freely receivable within the interior of the sleeve 19. The O-ring 24, in its relaxed state, has an outer diameter that is preferably receivable with clearance within the interior of the cylindrical member 15, as does the inner disc 21, although close sliding fits could be employed.

On that side facing the median disc 22 the inner disc 21 is frusto-conically beveled or chamfered, as indicated at 32, defining a seat for one side of the O-ring 24 which serves to axially compress the O-ring against the opposing face of the median disc 22 for radially outward expansion of the O-ring into clamping engagement with the cylindrical member 15 in response to actuation of the bolt 26. A similar arrangement is employed for the other O-ring 25 which has a relaxed outer diameter preferably, although not necessarily, receivable with clearance within a portion of the sleeve 19 which projects axially beyond the corresponding end of the cylindrical member 15. Thus, the outer disc 23 is also formed with a frusto-conically tapered annular face 33 on which O-ring 25 is seated and defining a shoulder with a radially outwardly projecting face 34 of a radius adapted to seat against the projecting end of the sleeve 19.

Figure 2:
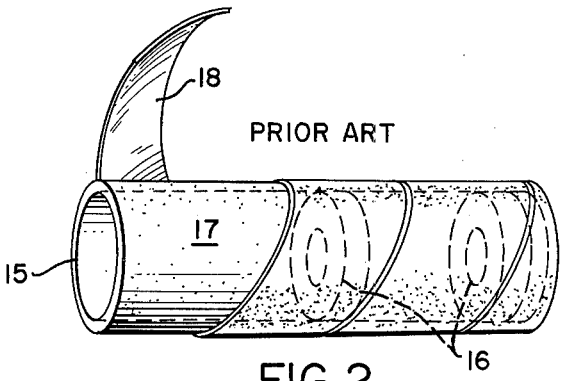
FIG. 2 is a perspective view of an idler roll construction of the prior art, the article being represented with a portion of the grit coated tape therefor partially removed from the underlying adhesive coated roll.

It is known in the prior art to provide an outer end cap for the idler roll of FIG. 2 utilizing the discs 21 and 22 and O-ring 24 and a shorter actuating bolt. However, the prior art end cap was primarily decorative and had no operative association with the grit coated tape 18 adhesively secured to the member 15. In other words, the presence or absence of the prior art end cap had no effect in either the use or maintenance of the idler roll. By contrast, the clamping mechanism of the present invention serves to securely key the disposable sleeve 19 to the cylindrical member 15 in a manner to prevent both relative axial and angular displacement of the disposable sleeve relative to the cylindrical support member for the sleeve.

As is now apparent, when the grit 20 of a sleeve 19 has accumulated excessive ink, the spent sleeve can be quickly removed merely by loosening nut 26 sufficiently to allow withdrawal of the clamping assembly and spent sleeve from their supporting cylinder 15 without removal of the cylinder from the press. After a new sleeve 19 has been placed on the cylindrical member 15, the clamping mechanism is reinserted into the open outer end of the member 15 to seat the shoulder 30 of the median disc 22 against the end of the cylindrical member 15. Thereafter, the sleeve 19 can be shifted axially, if necessary, to index one end of it into contact with the radial face 34 of the outer disc 23, after which the bolt 26 can be tightened to effect radial expansion of the O-rings 24 and 25 into clamping engagement with the cylinder 15 and sleeve 19, respectively. The entire operation is accomplished in a matter of seconds, as contrasted to the many minutes involved in the reworking of a prior art idler roller, and with relatively insignificant down-time of the printing press, as compared to the prior art arrangement.

While a specific embodiment of the invention has been described and illustrated, it will be understood that it is intended to be purely illustrative and not limitative.

I claim:

1. An idler roll for engaging a printed side of a running web trained thereover comprising:

a unitary rotatable support member of a rigid material having a hard smooth cylindrical external surface;

a sleeve of hollow cylindrical configuration made of stiff material with an internal surface telescopically matingly engaged with the external surface of said support member and having an external surface that is coated with grit for contacting a printed side of a web to be trained thereover;

and means at one end of said support member detachably interconnecting said support member and said sleeve at said one end for keying them together against both relative angular and relative axial displacement of said support member and said sleeve during operation of the idler roll, said means being actuable to disconnect said support member and said sleeve to permit said sleeve to be slideably withdrawn axially endwise over said one end of said support member;

said rotatable support member being of tubular configuration and said sleeve having an end portion projecting axially beyond an adjacent end of said support member;

said keying means comprising a coaxial series of an inner disc receivable within said member, a median disc formed with an annular shoulder seatable on an end of said support member within said projecting end portion of said sleeve, and an outer disc engagable with an end of said sleeve;

said keying means further comprising a first radially expandable and radially retractable element intermediate said inner and median discs and a second radially expandable and radially retractable element positioned between said median and outer discs.

2. An idler roll as in claim 1 in which:

said series of discs is coaxially mounted on an actuating shaft, said shaft and discs having coacting means to retain them in assembled relationship, each of said elements and the corresponding pair of discs between which one of said elements is disposed having coacting surfaces adapted to translate opposing movement of the corresponding pair of discs into radial expansion of the corresponding element.

3. An idler roll as in claim 2 in which said actuating shaft and coacting means comprise a headed bolt having an inner end threadedly engaged with said inner disc.

4. An idler roll as in claim 2 in which each of said elements comprises an O-ring of an elastomeric material.

* * * * *